United States Patent [19]

Vonalt

[11] Patent Number: 4,978,283

[45] Date of Patent: Dec. 18, 1990

[54] PRIMER VALVE FOR CHOP-CHECK PUMP

[75] Inventor: Kerry G. Vonalt, Edgerton, Ohio

[73] Assignee: The Aro Corporation, Bryan, Ohio

[21] Appl. No.: 404,493

[22] Filed: Sep. 8, 1989

[51] Int. Cl.[5] ..... F04B 7/00

[52] U.S. Cl. ..... 417/511

[58] Field of Search ..... 417/511; 137/512.15, 137/516.13, 516.15, 510

[56] References Cited

U.S. PATENT DOCUMENTS

| | | | |
|---|---|---|---|
| 1,357,624 | 11/1920 | Drew | 417/511 |
| 2,741,994 | 4/1956 | Donn | 417/511 |
| 3,335,673 | 8/1967 | DeForrest | 417/511 |
| 3,532,446 | 10/1970 | Herreshoff | 417/511 |
| 3,809,508 | 5/1974 | Uchiyama | 417/511 |
| 4,518,328 | 5/1985 | Nemoto | 417/511 |

*Primary Examiner*—A. Michael Chambers

*Attorney, Agent, or Firm*—Allegretti & Witcoff, Ltd.

[57] ABSTRACT

A chop-check pump for viscous material having cylinder means defining an axis, a drive rod axially movable within the cylinder means, a primer valve attached at one end of the drive rod and movable with the drive rod, and a floating check valve mechanism associated with the cylinder means at an outlet from the cylinder means through which the drive rod extends into the cylinder means. The primer valve includes a distal valve plate secured to the drive rod and a slidable valve plate on the drive rod slidable between a position against the distal valve plate and a position spaced from the distal valve plate. There are flow passages in both valve plates. Preferably, the flow passages in the slidable valve plate and the distal valve plate have a cross sectional area slightly less than the cross sectional area of the respective plates. In one embodiment, the slidable valve plate has a radial extent greater than that of the distal valve plate. The bottom of the distal valve plate is configured with a sharp leading edge for facilitating movement of the primer valve into the viscous material to be pumped.

11 Claims, 4 Drawing Sheets

PRIMER VALVE FOR CHOP-CHECK PUMP

BACKGROUND OF THE INVENTION

The present invention pertains to a chop-check pump, and more particularly to an improved chop-check pump for the pumping of heavy viscous material, with or without fibrous content.

Prior art pumps for viscous material which include a single plate fixed to a drive rod are known. Examples are the Lincoln Pile Drive Pump Model 83612, the Gray Company, Presidents Pumps Models 205-831 and 206-620; and the Pyles Industries, Inc. double-acting chopping check pump.

An improvement in such pumps with single plates was provided by pumps having two cooperating valves plates, with holes or passages in one of the valve plates. Examples of known pumps having two valve plates are the Series 4 pumps of Johnstone Pump Company, Inc. and the Model 650491 and 650492 pumps of The Aro Corporation, assignee of the present invention.

An object of this invention is to provide an improved chop-check pump for viscous material that provides improved penetration in heavy or thick materials.

Another object of the present invention is to provide a chop-check pump with an improved primer valve for enhancing flow characteristics by increasing the flow area and by providing a more direct path for material flow.

Yet another object of the present invention is to provide a chop-check pump having an improved primer valve comprised of a pair of cooperating plate members, with each of the plate members having flow passages therein.

Still another object of the present invention is to provide a chop-check pump for viscous material with an improved primer valve comprised of a pair of plate members, each with passages therethrough for the viscous material with one of the plate members fixed on an end of a drive rod and the other plate member axially slidable on the drive rod, the plate members cooperating to preclude flow of viscous material between the plate members in one direction of drive rod movement, and to permit flow of viscous material between the plate members in the opposite direction of drive rod movement, the fixed plate member constructed and arranged with an edge on the bottom configured to facilitate penetration of the primer valve into viscous material.

Yet another object of the present invention is to provide an improved primer valve for a chop-check pump comprised of a pair of plate members, one fixed on a drive rod and the other slidable on the drive rod toward and away from the fixed plate member, the plate members each having flow passages therethrough, the cross-sectional area of the flow passage in the slidable valve being slightly less than one-half the cross-sectional area of the slidable valve plate.

Other objects and advantages of the present invention will be made more apparent hereinafter.

BRIEF DESCRIPTION OF THE DRAWING

There is shown on the attached drawing a presently preferred embodiment of the present invention wherein like numerals refer to like elements in the various views and wherein.

DETAILED DESCRIPTION OF THE INVENTION

Figure 1:
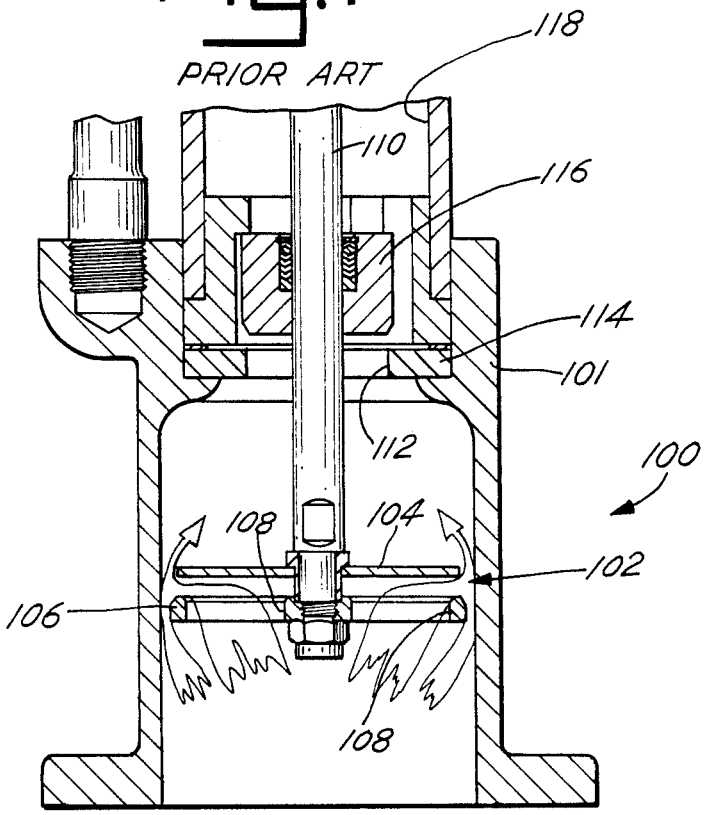
Fig. 1 PRIOR ART
FIG. 1 is a detail side elevation view, partially in section, illustrating a prior art chop-check pump having a primer valve with two plates, only one of which has passages therethrough.

In FIG. 1 there is shown a detail elevation view of a prior art chop-check valve 100 having a cylinder or housing 101 containing a primer valve 102 comprised of two valve plates 104 and 106. The valve plate 106, which has flow openings 108 therethrough is secured to the end of the drive rod 110. The valve plate 104 is axially slidable on the drive rod 110 between a first position against the valve plate 106, precluding flow through the flow openings 108, and a second position spaced from the valve plate 106, as shown in FIG. 1 to permit flow of viscous material through the flow openings 108. The viscous material will pass through the opening 112 in valve seat 114 and about the floating check valve 116 into chamber 118, from which it can be pumped to a desired place, for example, a storage tank.

Figure 2:
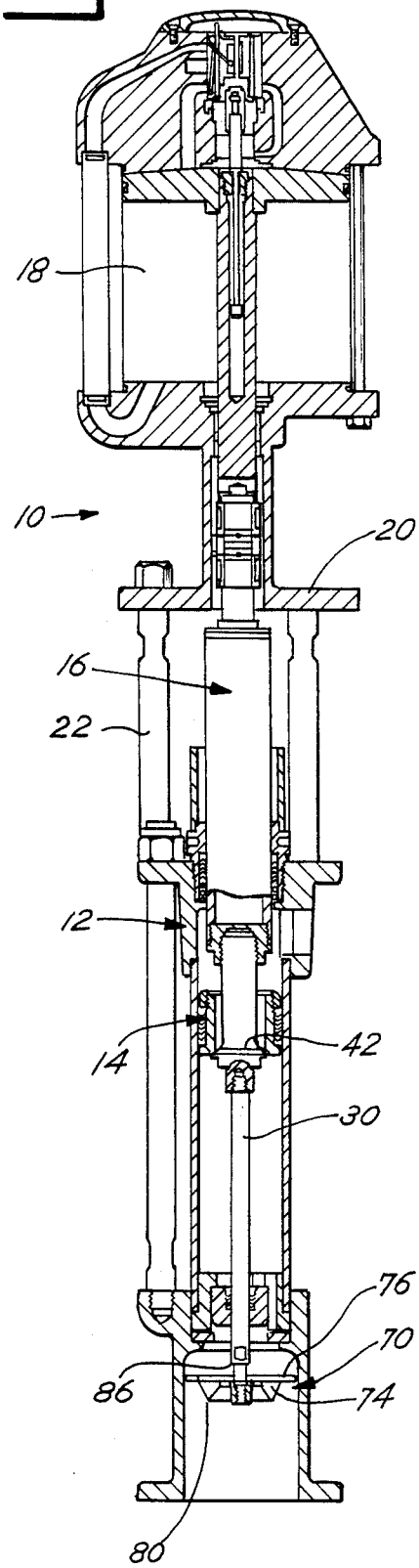
FIG. 2 is a side elevation view partially in section of a chop-check pump embodying the present invention, and illustrating the primer valve closed during upstroke operation.
Figure 3:
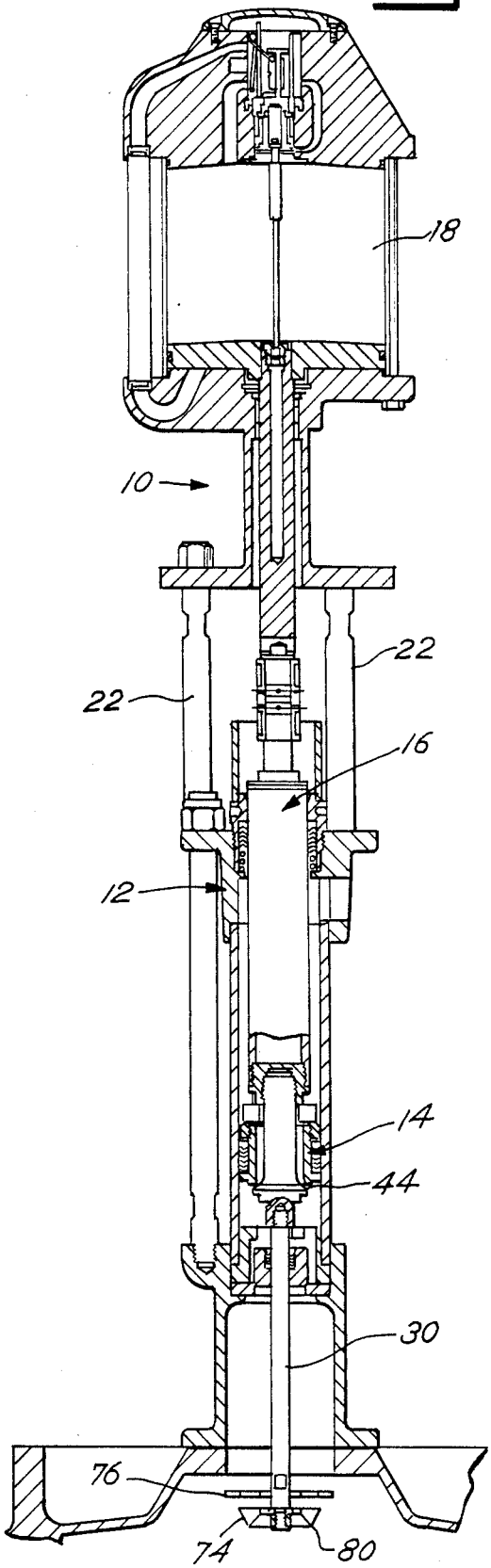
FIG. 3 is a side elevation view similar to FIG. 2, and illustrating the primer valve open during downstroke operation of the chop-check pump.

Referring to FIGS. 2 and 3, there is shown the chop-check pump of the present invention. The chop-check pump 10 comprises basically a cylinder means 12 containing therein piston means 14, which are actuated by drive rod means 16 operatively connected to motor means 18 for moving same axially within the cylinder means 12.

The motor means 18 may be an air motor having a flange 20 at the lower end. Spacer rods 22 connect the flange 20 of the air motor 18 to the cylinder means 12. The air motor 18 is connected to a suitable source of air, e.g. 150 p.s.i., and is adapted to reciprocate the drive rod means 16 to which it is connected at the upper end.

The drive rod means 16 comprises an upper rod 26 secured at its upper end to the air motor 18 and a lower rod 30. The upper rod 26 has an enlarged intermediate rod section 28. The lower rod 30 is connected at its upper end in a suitable manner to intermediate rod section 28.

Piston means 14 comprises an annular piston 36 carried about the intermediate rod 28 of the drive rod means 16. Packing 38 is provided between piston 36 and the inner wall of the cylinder means 12 to help seal between the exterior of piston 36 and the inner wall of the cylinder means 12. A flow passage 40 is provided between the internal wall of the piston 36 and the exterior of the intermediate rod 28. Valve surface 42 is formed on the intermediate rod section 28. The valve surface 42 is adapted to cooperate with a valve seat 44 on the piston 36. When the valve surface 42 engages the valve seat 44 as shown in FIG. 2, flow of material from the chamber 48 to the flow passage 40 is precluded. When the valve surface 42 is away from the valve seat 44 on the piston 36, as shown in FIG. 2, material can pass from chamber 48 to flow passage 40.

It will be understood that piston 36 is confined for movement between a shoulder 49 on the lower end of the upper rod 26 and the valve surface 42. The piston 36 has a lesser axial extent than the distance between the shoulder 49 and the valve surface 42.

An outlet 50 is provided in the side of the cylinder means 12. Material pumped by chop-check pump 10 will pass through outlet 50 into a suitable conduit for discharge as desired.

A floating check valve mechanism 56 is provided in the cylinder means 12 adjacent the valve seat 58 for opening and closing the passage through the valve seat 58. Sleeve 60 is secured to the cylinder means 12 at the bottom of chamber 48. Sleeve 60 has a shoulder 62 for limiting upward movement of the body 64 of the floating check valve mechanism 56.

The primer valve 70 of the present invention is connected to the lower rod 30. The primer valve 70 comprises a distal valve plate 74 affixed to the end of the lower rod 30 and a slidable valve plate 76 slidable axially on the lower rod 30 between a position engaging the distal valve plate 74 (FIG. 2) and a position spaced from the distal valve plate 74 (FIG. 3).

The slidable valve plate 76 has an outer diameter greater than that of the distal valve plate 74. The configuration of the slidable valve plate 76 is complementary to that of the interior of the wall of the cylinder with which it is associated. In the embodiment shown, both the slidable valve plate 76 and the interior wall of the cylinder or housing are cylindrical.

There are flow openings in both the distal valve member 74 and the slidable valve member 76 for maximizing the flow area for the flow of viscous material into chamber 48, as will be described more fully with reference to FIGS. 4–7.

Figure 4:
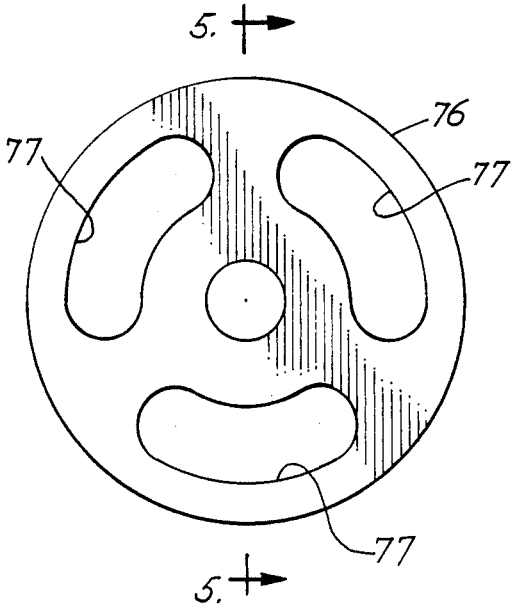
FIG. 4 is a plan view of the distal valve plate of the chop-check pump of FIGS. 2 and 3.
Figure 5:
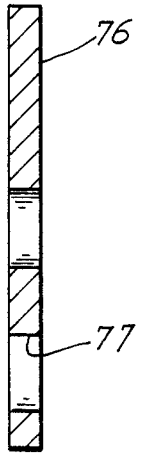
FIG. 5 is a cross-sectional view of the distal valve plate taken along line 5—5 by FIG. 4.

As best seen in FIGS. 4 and 5, the slidable valve plate 76 is generally a washer-like element having slot-like openings 77 therein. The embodiment of FIG. 4 shows three openings 77, each having the general configuration of an elongated arcuate slot. The openings 77 are rounded at the ends. The sides are generally curved and in parallel relationship to one another.

Figure 6:
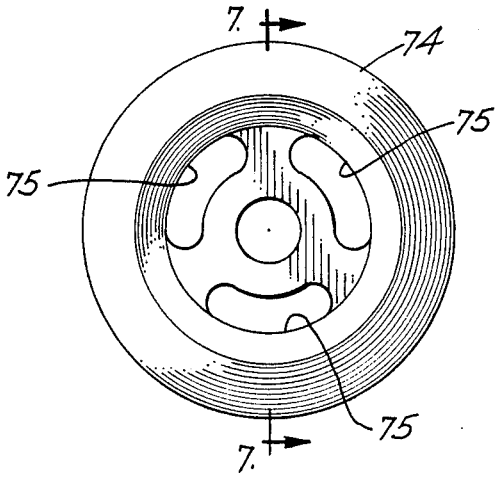
FIG. 6 is a plan view of the slidable valve plate of the chop-check valve of FIGS. 2 and 3.

The distal valve plate 74 is constructed and arranged to provide a sharp edge 80 on the bottom for facilitating penetration of the primer valve into the viscous or stick material to be pumped. (See FIGS. 2, 3 and 7). The sharp edge 80, is formed at the apex of converging planar surfaces 82, 84 which define the bottom of the distal valve plate 74. Material will be directed both outwardly of the distal plate member 74 by surface 82 and inwardly to the passage means in the distal plate member 74 by surface 84. The embodiment of FIG. 6 shows three openings 75, each having the general configuration of an elongated, arcuate slot. The combined areas of the elongated, arcuate slot-like openings 75 is slightly less than one half of the combined areas of the openings 77. Central openings in the plates 74, 76 receive the drive rod.

The openings 75 of the distal valve plate 74 and the openings 77 of the slidable valve plate 76, are configured in design so that when the plates 74 and 76 are abutting one against the other, the openings are closed. In other words, the pattern of slots or openings 75 and 77 is such that a solid plate is provided as a result of the plate 74 and 76 impinging one upon the other. As previously described the plates 74 and 76 do engage one against the other during the upstroke or pumping stroke of the pump. During the downstroke or return stroke of the pump, the slidable plate 76 which has a greater diameter or extent than the fixed or distal plate 74 will separate from the distal plate 74 due to the action of the fluid against the peripheral edge of the slidable valve plate 76. When separated a limited distance determined by the extent of a stop or shoulder 80 on the rod 30, the passages in the distal plate 74 are effectively opened for flow of viscous material therethrough. Similarly, the passages in the slidable valve plate 76 are opened or exposed for flow of viscous material therethrough. Thus, when the plates 74 and 76 are separated a continuous flow path is defined through the plates. When the plates 74 and 76 are not separated and overlay one another in abutting relationship, the openings through the plates are effectively closed.

The particular pattern or flow path in the plates 74 and 76 maybe varied depending upon the material which is being pumped and various other needs. The stroke or movement of the slidable plate 76 may also be varied depending upon the fluid being pumped and other requirements.

The valve plate 74 may be adjustably secured in axial relationship along the drive rod 30 by suitable means, e.g. a threaded bolt and shims or a threaded connection between the distal valve plate and the drive rod and a lock nut for retaining plate 74 in adjusted position. The distance between the top surface of the valve plate 74 and the shoulder 86 on the drive rod 30 can be adjusted. In this matter the stroke or amount of axial movement of the slidable valve plate 76 can be adjusted.

In FIGS. 8 to 15 there are shown alternative valve plates having additional configuration of the slots or openings in the plates. The plates 174 and 176 (FIGS. 8 and 9) have pluralities of straight elongated slots 175, 177 respectively. The respective slots 175, 177 are generally perpendicular to a radius in respective quadrants. Note that plates 174 and 176 are keyed to the rod 30 so that when slidable valve plate 176 slides on the rod 30 it will maintain its orientation. In such circumstance a pattern of slots associated with each of the plates 174 and 176 is such that the slots are arranged at generally equal radial distances from the rod 30. This is possible since the plates 174 and 176 cannot rotate relative to one another. The slots or openings 175 and 177 in the two plates 174 and 176 are radially offset, or non-aligned, as viewed in plan. During the upstroke, the valve plates 174 and 176 will abut to as to preclude flow of material through the slots or openings in the valve plates. During the downstroke, the valve plates 174 and 176 will separate and flow will be permitted through the slots or openings 175, 177.

Figure 10:
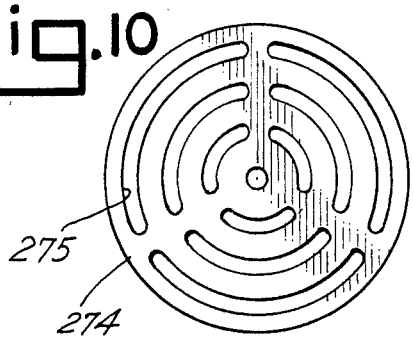
FIG. 10 is a plan view of a further modified distal valve plate.
Figure 11:
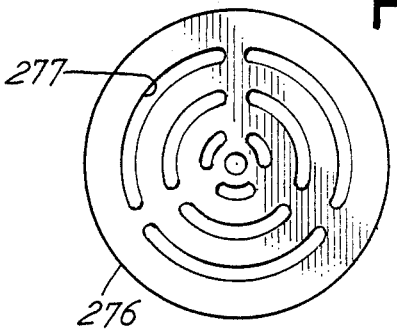
FIG. 11 is a plan view of a modified slidable valve plate that is associated with the distal valve plate of FIG. 10.

FIGS. 10 and 11 illustrate plates 274 and 276 having elongated arcuate slots 275 and 277 respectively. Because of the curved nature and arrangement of the slots 275 and 277, it is not necessary to maintain a specific radial orientation of one plate with respect to the other.

Note also that the area of the flow through passages or openings in plates 74, 76, 174, 176, 274, 276 relative to the areas of the plates will generally be slightly less than one-half the area of the respective plates.

Figure 12:
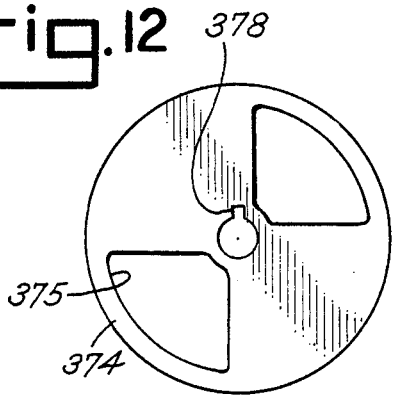
FIG. 12 is a plan view of another modified distal valve plate.
Figure 13:
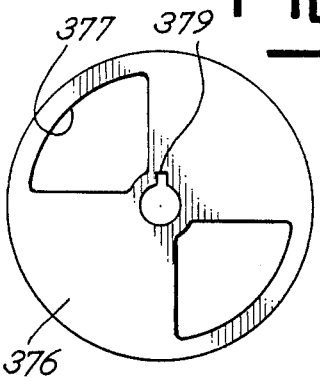
FIG. 13 is a plan view of a modified slidable valve plate that is associated with the distal valve plate of FIG. 12.

FIGS. 12 and 13 show a further embodiment of valve plates wherein the plates are keyed to the drive shaft to maintain the openings in each plate in a predetermined radial orientation. Fixed valve plate 374 and slidable valve plate 376 have substantially identical openings 375 and 377 therein. The openings are in opposed quadrants and occupy essentially a quadrant. The openings in one plate are the reverse of the openings in the other plate. The plates 374 and 376 may be keyed to a drive rod through keyed slots 378 and 379 respectively.

Figure 14:
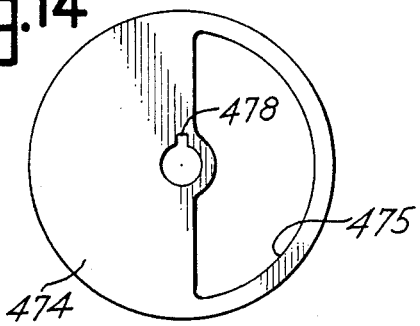
FIG. 14 is a plan view of yet another modified distal valve plate member.
Figure 15:
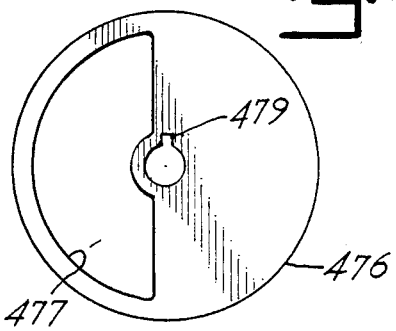
FIG. 15 is a plan view of a slidable valve plate that is associated with the distal valve plate of FIG. 14.

FIGS. 14 and 15 show a further embodiment of valve plates similar to the embodiment of FIGS. 12 and 13, wherein the opening in one plate is the reverse of that in the other plate. The opening 475 in plate 474 occupies almost one-half of the area of the plate 474. Similarly opening 477 occupies almost one-half of the area of plate 476. The plates 474 and 476 may be keyed to a drive rod through keyed slots 478 and 479 to maintain the radial orientation of the openings 475 and 477.

The fixed valve plate may be larger or smaller in outside diameter than the slidable valve plate or the plates could have substantially the same outer diameter as shown in the embodiments of FIGS. 8 and 9, FIGS. 10 and 11, FIGS. 12 and 13 and FIGS. 14 and 15.

Figure 7:
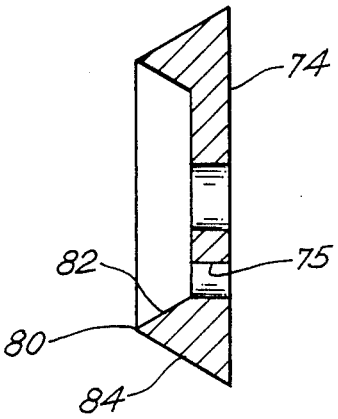
FIG. 7 is a cross-sectional view of the slidable valve plate taken along line 7—7 of FIG. 6.
Figure 8:
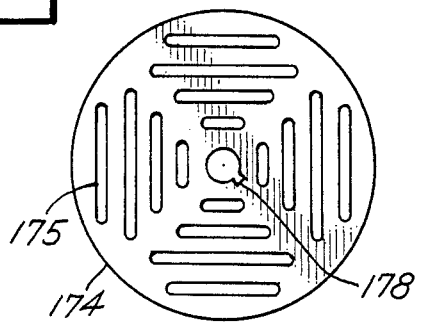
FIG. 8 is a plan view of a modified distal valve plate.
Figure 9:
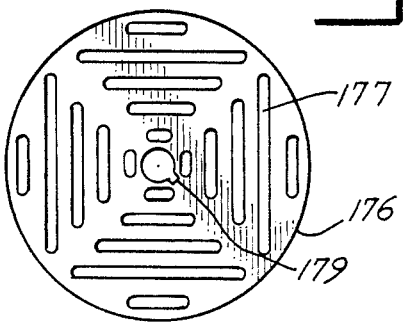
FIG. 9 is a plan view of a modified slidable valve plate that is associated with the distal valve plate of FIG. 8.

Though the bottoms of the distal valve plates are not shown in the embodiments of FIGS. 8, 10, 12 and 14, it is preferred that the bottoms be constructed and arranged with a circular sharp edge similar to that shown in FIG. 7.

As with the earlier described embodiments, the areas of the flow passages or openings in plates 374, 376 and 474, 476 will generally be slightly less than one-half the areas of the respective plates.

The improved primer valve of the present invention increases penetration into viscous materials and provides for improved flow through the primer valve. Contributing to the improved performance in one important aspect is the uniquely configured distal valve plate bottom. Another aspect of the improved primer valve for a chop-check valve is the enhanced flow path provided by the flow passages in both the distal valve plate and the slidable valve plate. Yet another aspect of improvement is the construction of the slidable valve plate such that the area of the flow passages therethrough are slightly less than one-half the cross-sectional area of the slidable valve plate.

While a presently preferred embodiment of the invention has been shown and described, it will be understood that various changes and modifications may be made therein without departing from the invention. Therefore, it is intended in the appended claims to cover all such changes and modifications as fall within the true spirit and scope of the invention.

I claim:

1. In a chop-check pump for viscous material, said pump of the type having cylinder means defining an axis, a drive rod which is axially movable within the cylinder means, a primer valve attached to one end of the drive rod and moveable with the drive rod, a floating check valve mechanism associated with the cylinder means at an outlet from the cylinder means at the end through which the drive rod extends into the cylinder means, the improvement comprising:

a primer valve including a distal valve plate at the end of the rod and fixed to the rod, said distal valve plate having flow passage means therein, and a slidable valve plate on the drive rod slidable between a position against the distal valve plate and a position spaced from the distal valve plate, said slidable valve plate having a radial extent greater than that of the distal valve plate, said slidable valve plate having a configuration complementary to that of the cross section of the cylinder means, the slidable valve plate having flow passage means which is exposed only when the plates are separated upon movement of the drive rod in a first direction into the cylinder and engagement of the valve plates with a viscous material within the cylinder means, said flow passage means being closed to flow upon the slidable valve plate engaging against the distal plate when the drive rod is moved in the reverse direction to thereby pump fluid from the cylinder means in response to movement of the slidable valve plate and distal valve plate.

2. The improvement of claim 1 wherein the flow passage means in the slidable valve plate is at least slightly less in cross-sectional area than the cross-section area of the flow passage means in the distal valve plate.

3. The improvement of claim 1 wherein flow passage means in the slidable valve plate has an area slightly less than one-half of the area of the slidable valve plate.

4. The improvement of claim 1 wherein the bottom of the distal valve plate is configured for facilitating downward movement of the primer valve into the viscous material.

5. The improvement of claim 1 wherein the bottom of the distal valve plate is configured for facilitating movement of the primer valve into the viscous material and for directing viscous material through the passage means and about the periphery of the distal plate.

6. The improvement of claim 1 wherein the distal valve plate has a sharp edge formed on the bottom thereof for facilitating downward movement of the primer valve into the viscous material.

7. The improvement of claim 1 wherein the flow passage means in the slidable valve plate comprises at least one slot-like opening.

8. The improvement of claim 1 wherein the flow passage means in the distal valve plate comprises at least one slot-like opening.

9. In a chop-check pump for viscous material, said pump of the type having cylinder means defining an axis, a drive rod which is axially movable within the cylinder means, a primer valve attached to one end of the drive rod and moveable with the drive rod, a floating check valve mechanism associated with the cylinder means at an outlet from the cylinder means at the end through which the drive rod extends into the cylinder means, the improvement comprising:

a primer valve including a distal valve plate at the end of the rod and fixed to the rod, said distal valve plate having flow passage means therein, and a slidable valve plate on the drive rod slidable between a position against the distal valve plate and a position spaced from the distal valve plate, said slidable valve plate having a configuration complementary to that of the cross section of the cylinder means, the slidable valve plate having flow passage means which is exposed only when the plates are separated upon movement of the drive rod in a first direction into the cylinder and engagement of the valve plates with a viscous material within the cylinder means, said flow passage means being closed to flow upon the slidable valve plate engaging against the distal plate when the drive rod is moved in the reverse direction to thereby pump fluid from the cylinder means in response to movement of the slidable valve plate and distal valve plate.

10. The improvement of claim 9 wherein flow passage means in the slidable valve plate has an area slightly less than one-half of the area of the slidable valve plate.

11. The improvement of claim 9 wherein the bottom of the distal valve plate is configured for facilitating movement of the primer valve into the viscous material and for directing viscous material through the passage means and about the periphery of the distal plate.

* * * * *